US007420885B2

(12) United States Patent
Claret et al.

(10) Patent No.: US 7,420,885 B2
(45) Date of Patent: Sep. 2, 2008

(54) TIMEPIECE PROVIDED WITH OPEN DIAL PLATE

(75) Inventors: Christophe Claret, Chez-le-Bart (CH); Jan Dubois, La Chaux-de-Fonds (CH); Alain Schiesser, Neuchâtel (CH); Fawaz Gruosi, Prangins (CH)

(73) Assignee: Christophe Claret S.A., Le Locle (CH)

( * ) Notice: Subject to any disclaimer, the term of this patent is extended or adjusted under 35 U.S.C. 154(b) by 0 days.

(21) Appl. No.: 11/814,135

(22) PCT Filed: Jan. 19, 2006

(86) PCT No.: PCT/EP2006/050322

§ 371 (c)(1),
(2), (4) Date: Jul. 17, 2007

(87) PCT Pub. No.: WO2006/077240

PCT Pub. Date: Jul. 27, 2006

(65) Prior Publication Data

US 2008/0130423 A1 Jun. 5, 2008

(30) Foreign Application Priority Data

Jan. 24, 2005 (CH) ..... 0099/05

(51) Int. Cl.

| | |
|---|---|
| ***G04B 23/00*** | (2006.01) |
| ***G04B 23/02*** | (2006.01) |
| ***G04B 21/02*** | (2006.01) |
| ***G04B 19/00*** | (2006.01) |
| ***G04B 21/00*** | (2006.01) |

(52) U.S. Cl. ..... 368/265; 368/72; 368/75; 368/223; 368/269

(58) Field of Classification Search ..... 368/72–75, 368/243, 244, 248, 262–273
See application file for complete search history.

(56) References Cited

U.S. PATENT DOCUMENTS

| | | | |
|---|---|---|---|
| 2,625,087 | A | 1/1953 | Steineck |
| 3,747,330 | A | 7/1973 | Tupone |

(Continued)

FOREIGN PATENT DOCUMENTS

| | | |
|---|---|---|
| CH | 497 728 | 10/1970 |

(Continued)

OTHER PUBLICATIONS

International Search Report PCT/EP2006/050322 related to subject application.

(Continued)

*Primary Examiner*—Vit W Miska
(74) *Attorney, Agent, or Firm*—Townsend M. Belser, Jr.; Nexsen Pruet, LLC

(57) ABSTRACT

A watch with a clockwork comprising a ringer whose actuation is controlled from outside the watch by means of a control unit, a dial plate comprising an opening, a shutter (10) movable between a first position covering the opening and a second position leaving the opening free. The control unit (12) is arranged in such a way that it enables the shutter to be moved from the first position to the second position when the ringer is actuated.

12 Claims, 10 Drawing Sheets

U.S. PATENT DOCUMENTS

| | | | | |
|---|---|---|---|---|
| 4,941,137 | A * | 7/1990 | Kikuchi | 368/223 |
| 5,044,961 | A * | 9/1991 | Bruskewitz | 434/304 |
| 5,161,130 | A * | 11/1992 | Sato et al. | 368/228 |
| 5,222,053 | A | 6/1993 | Ohhira | |
| 6,229,768 | B1 * | 5/2001 | Nakazawa et al. | 368/223 |
| 6,262,947 | B1 | 7/2001 | Pulver | |
| 6,361,325 | B1 * | 3/2002 | McGuire | 434/304 |

FOREIGN PATENT DOCUMENTS

| | | |
|---|---|---|
| CH | 685 363 | 6/1995 |
| EP | 0 484 821 | 5/1992 |
| EP | 0 938 023 | 8/1999 |
| FR | 2 790 564 | 9/2000 |

OTHER PUBLICATIONS

Swiss Search Report CH00099/05 related to subject application.

Automated English Translation (Abstract) of above Foreign Patent (F) No. CH 685 363 as obtained from website http://www.espacenet.com.

Automated English Translation (Abstract) of above Foreign Patent (H) No. EP 0 938 023 as obtained from website http://www.espacenet.com.

Automated English Translation (Abstract) of above Foreign Patent (I) No. FR 2 790 564 as obtained from website http://www.espacenet.com.

* cited by examiner

TIMEPIECE PROVIDED WITH OPEN DIAL PLATE

BACKGROUND OF THE INVENTION

1) Field of the Invention

The present invention relates to the clockwork field. It relates more specifically to a timepiece whereof the dial comprises an opening which may be covered or left free to show part of the clockwork.

2) Description of Related Art

The appeal of a watch resides, of course, in its appearance. But one tends to see a strong interest in timepieces which leave their mechanism visible, in whole or in part. It is now very common to cut out part of the dial to show, for example, a tourbillon. Skeleton watches are also known. Nevertheless, this type of timepiece sometimes lacks discretion and now, originality.

Watches provided with a transparent back cover are also known, but it is tiresome to have to remove it and turn it around to see the clockwork.

SUMMARY OF THE INVENTION

The present invention aims to resolve the aforementioned drawbacks by proposing a dial having at least one retractable portion to display the clockwork or a particular mechanism.

More specifically, the invention relates to a watch provided with a clockwork comprising a striking mechanism whose release is controlled from outside the watch by means of a control unit. The watch comprises a dial comprising an opening, a shutter movable between a first position in which it covers said opening and a second position in which it leaves the opening free.

According to the invention, the control unit is arranged such that it enables the shutter to be moved from the first to the second position thereof when the striking mechanism is released.

Advantageously, the shutter comprises a plurality of segments distributed alternately on two levels and forming a diaphragm of the type used in photographic devices.

In a preferred embodiment, the clockwork comprises a minute repeater mechanism provided with its own control and the control unit of the shutter is connected to the control for the minute repeater mechanism.

The control unit being connected to the shutter through a linking piece connected to a piston, the delay system comprises:

- a hooking member able to occupy a first position in which it leaves this linking piece free and a second position in which it cooperates with the linking piece,
- a spring member maintaining the hooking member in its second position, and
- a release member released upon return of the control unit to its locking position, to counter the force exerted by said spring and allow passage of the hooking member from its second to its first position.

BRIEF DESCRIPTION OF THE DRAWING(S)

Other details will appear more clearly upon reading the following description, provided in reference to the annexed drawing in which.

DETAILED DESCRIPTION OF THE INVENTION

In the figures, we have illustrated a watch provided with a clockwork and a dial. The latter is provided with an opening through which the clockwork can be seen. According to the invention, the watch is equipped with means for covering the opening. It comprises:

- a shutter 10 movable between a first position, in which it covers the opening, and a second position, in which it leaves the opening free, and
- a control unit 12 actuating the opening of the shutter 10.

In the specific example presented below, the mechanism is combined with a minute repeater, a system well known by one skilled in the art and which will not be described in detail. This combination offers additional advantages which will appear below, but it is not essential.

Covering Mechanism

The covering device forms an independent module, able to be combined with a basic clockwork. It goes between the display and the clockwork.

Figure 2:
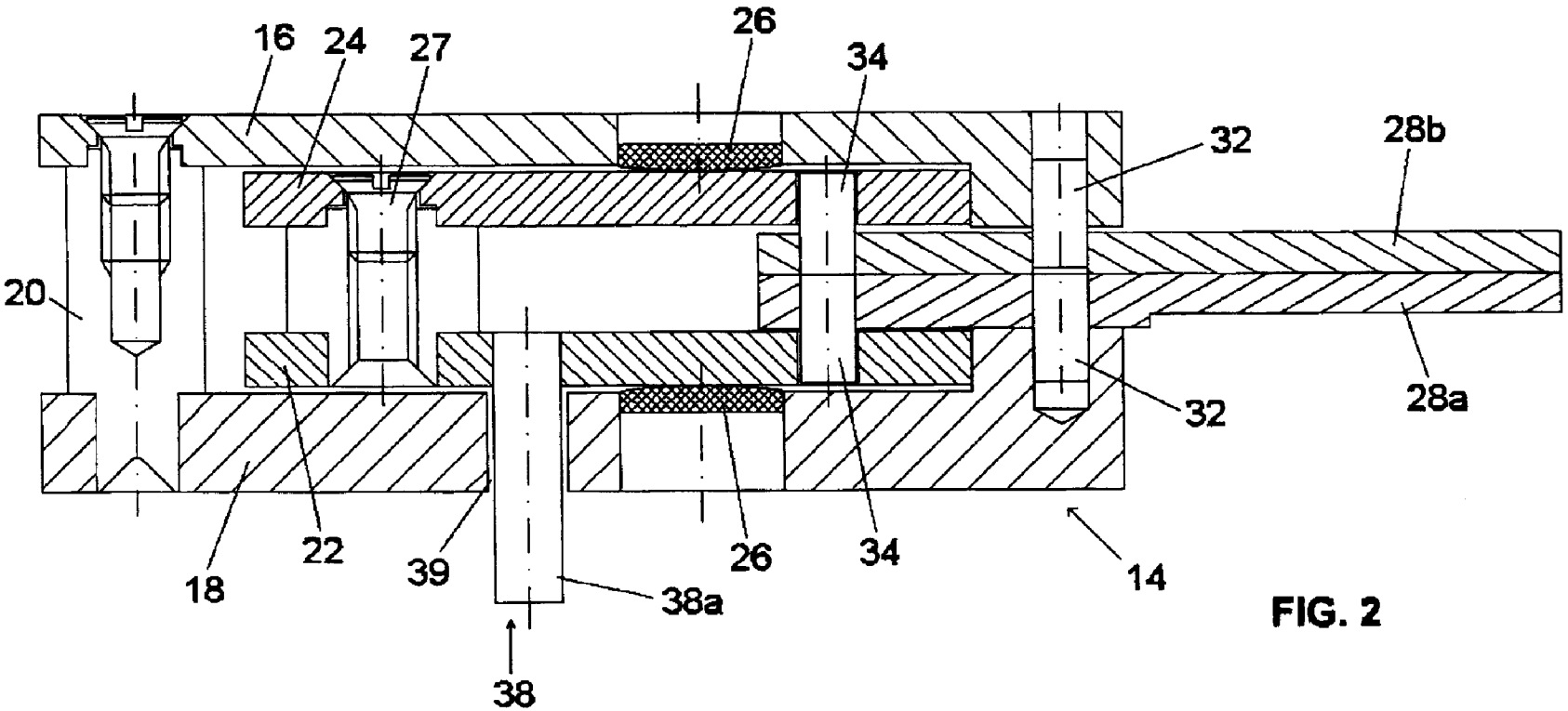
FIG. 2 is a cross-section of the mechanism according to the invention.
Figure 3:
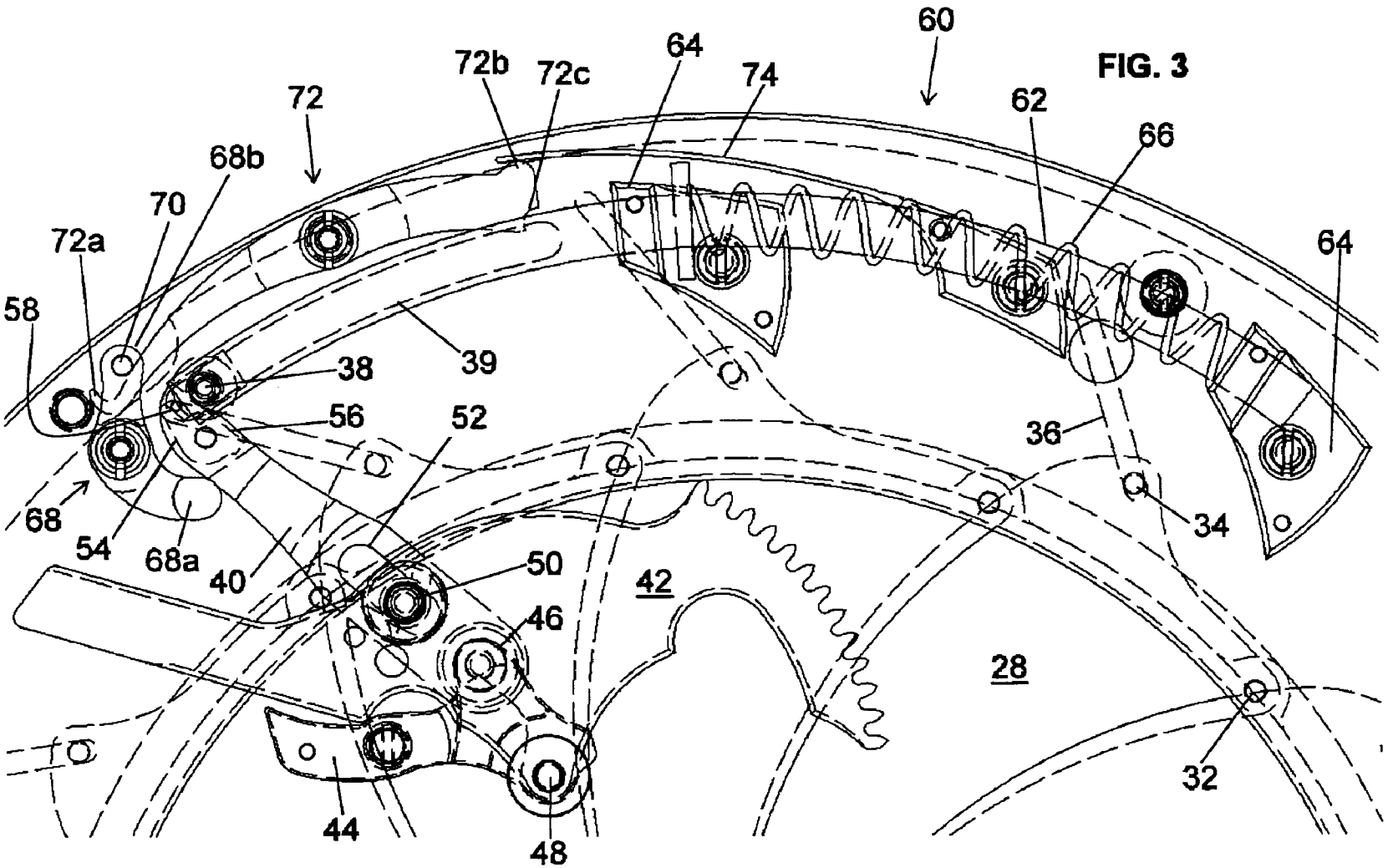
FIGS. 3 to 7 illustrate different positions of the mechanism.
Figure 4:
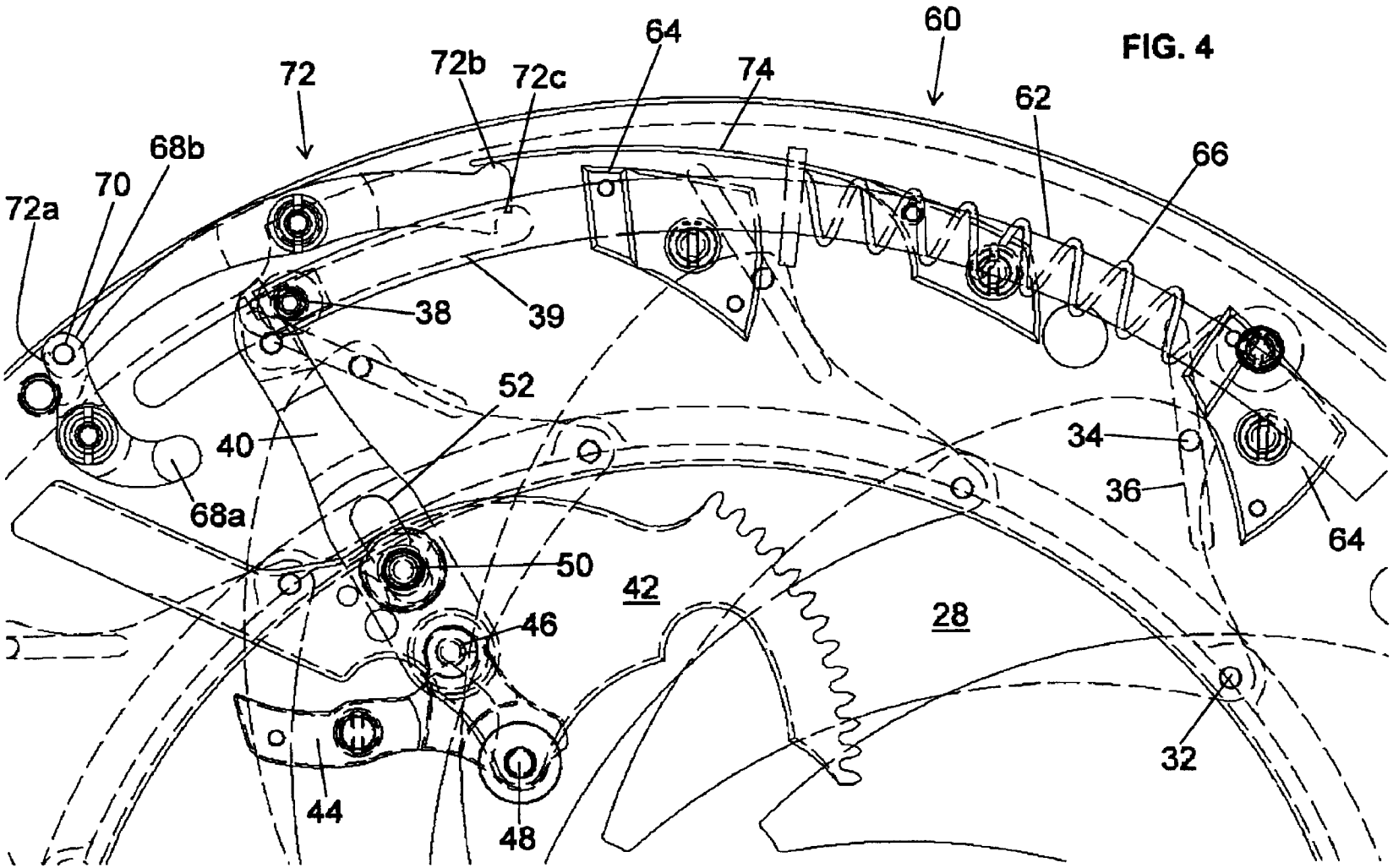
Figure 5:
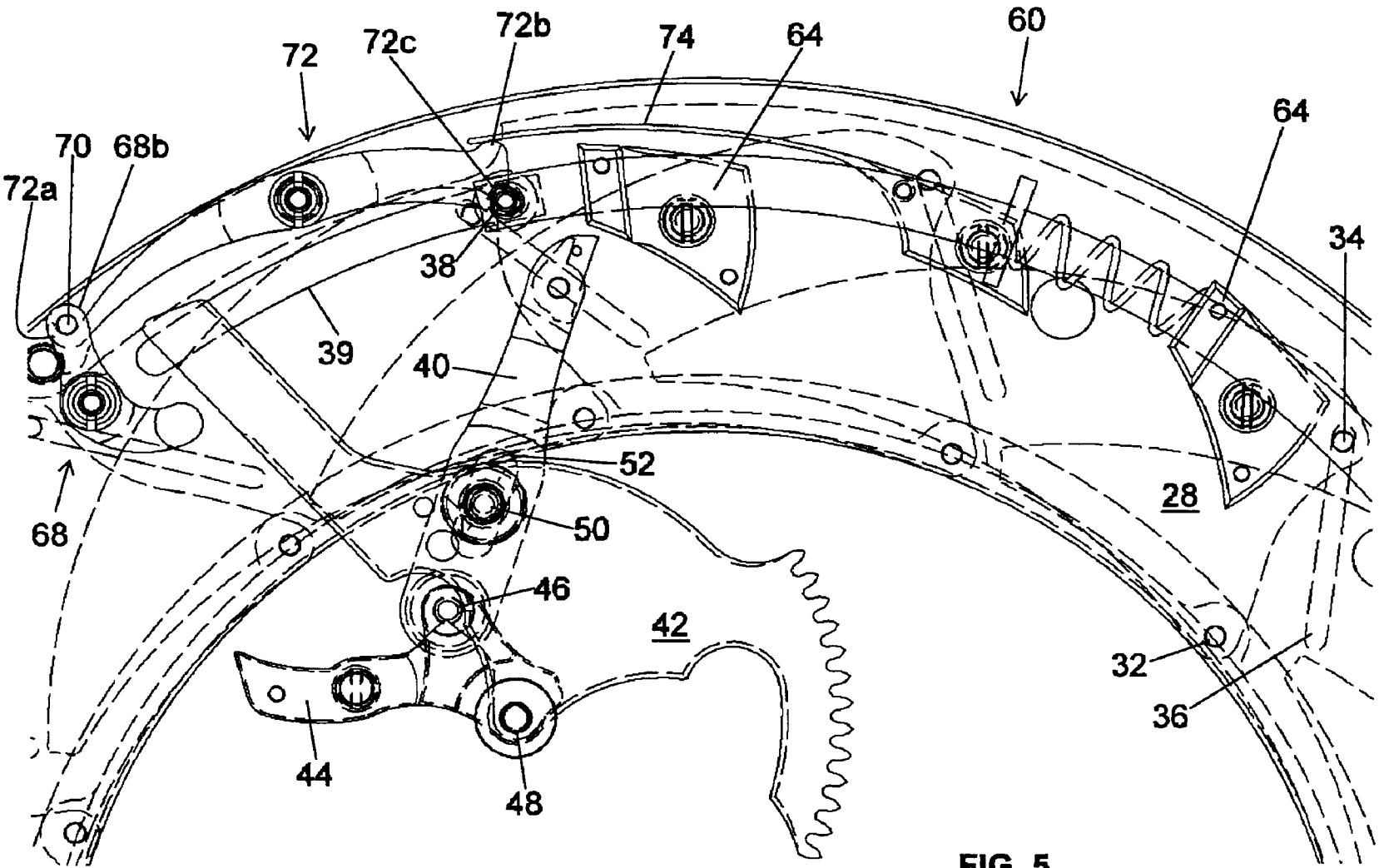
Figure 6:
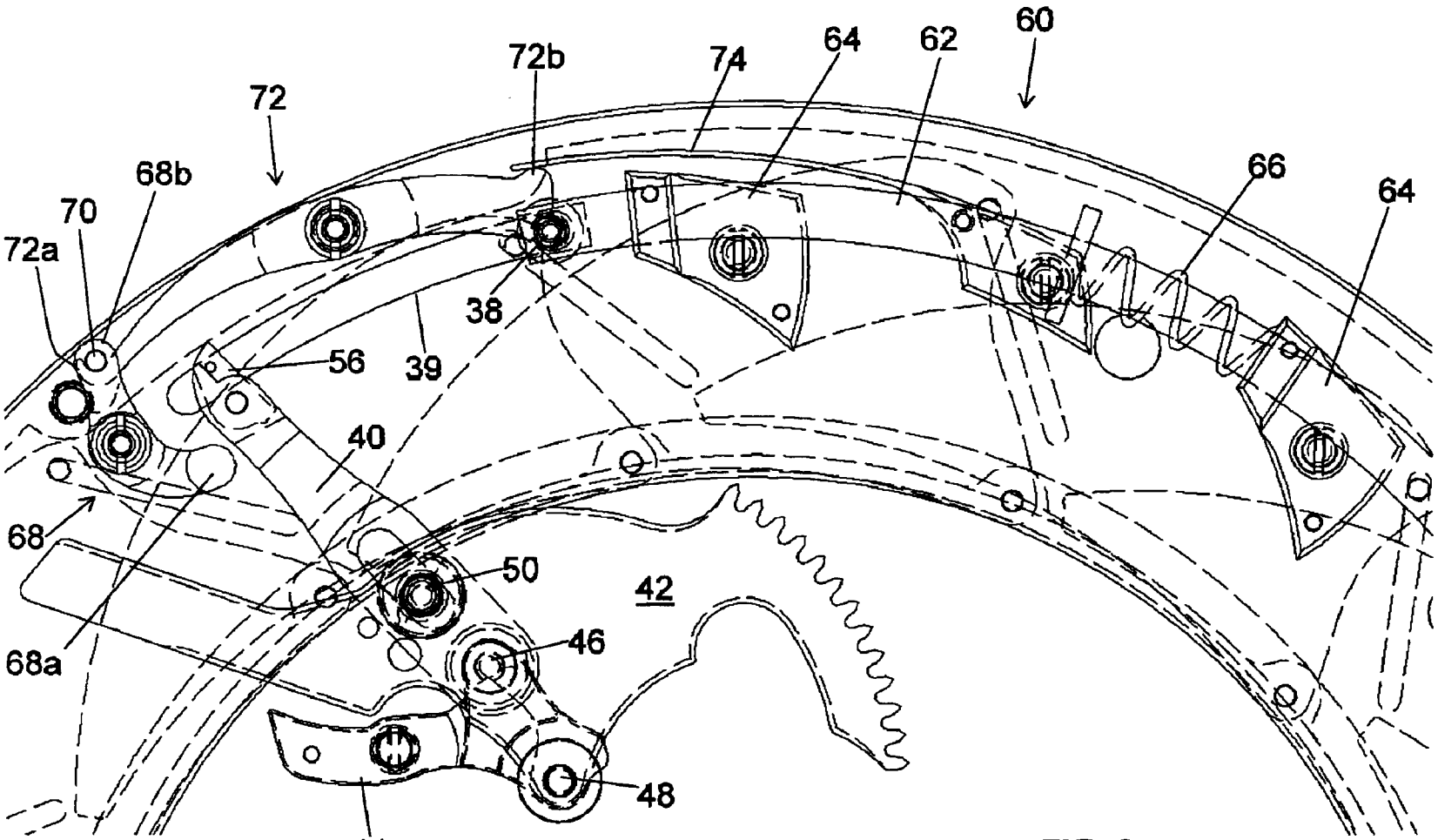
Figure 7:
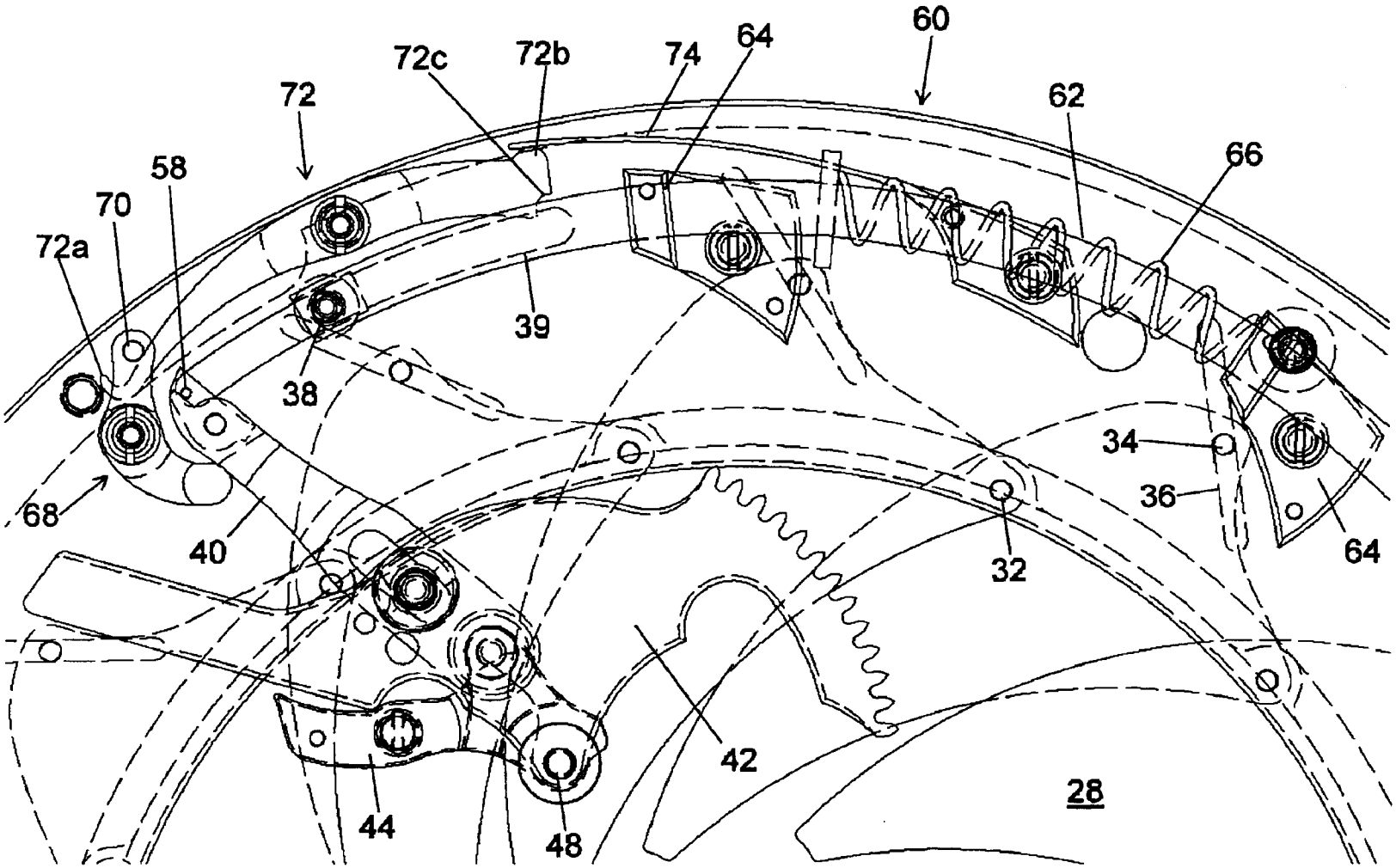

As illustrated in FIG. 2 in particular, the module is mounted in a frame 14 made up of two rings, one 16 of which is intended to form the edge of the dial and the other 18 the bottom of the module. For convenience, we will call the first "dial" 18 and the second "bottom" 18. They are rigidly connected to each other by a plurality of pillars 20.

Two ring-shaped cams, one lower 22 and the other upper 24, are arranged on jewels 26, between the dial 16 and the bottom 18 and concentrically in relation to the latter parts. Said cams are made integral with each other by pillars 27 and are shown mobile in rotation around the center of the module. As will be understood later, these cams transmit the force of the control unit 12 to the to the shutter 10.

The shutter 10 is located between the two cams 22 and 24. It is made up of a plurality of segments 28, distributed alternately on two levels and forming a diaphragm of the type used in photographic devices.

Figure 1:
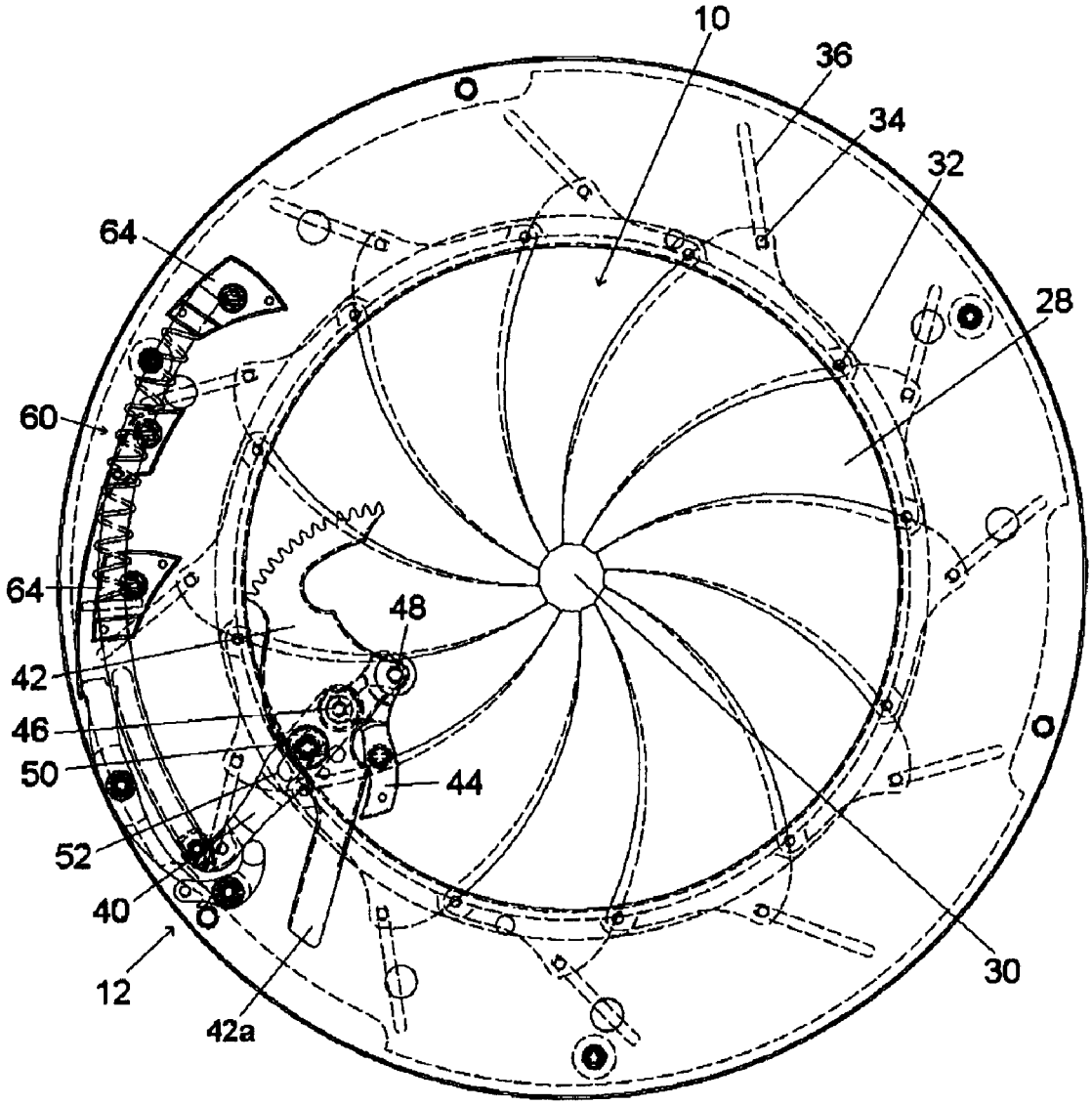
FIG. 1 is a general top view showing the shutter in its first position.

Each segment comprises a thin end and a large end. In the first position of the shutter 10 (FIG. 1), the thin ends form, in the center of the module, a circular opening 30 intended to allow passage of the hour wheel bearing the display hands. The large end comprises, at one of its corners, a pivot point 32 and, in the other corner, a translation pin 34, as explained below.

For the segments of the lower level 28*a*, the pivot point 32 is installed in the bottom of the module. Their translation pin 34 is disposed in a groove 36 located in the lower cam 22 in which the pin 34 can slide.

For the segments of the upper level 28*b*, the pivot point 32 is connected to the dial 16. Their translation pin 34 is disposed in a groove 36 located in the upper cam 24 in which the pin 34 can slide.

The shutter 10 is connected to the control unit through a linking piece. This takes the form of a pin 38 integral with the lower cam and crossing the bottom 18 through a window 39 which it comprises. The pin 38 is long enough that it has, at the clockwork of the watch, a portion 38*a* intended, as we will see below, to cooperate with the control unit 12. The window 39 is therefore sized to allow the pin 38 to make a sufficient travel to open and close the diaphragm.

When the diaphragm is in the closed position, the cams 22 and 24 are made to rotate relative to the frame 14 by the control unit 12, via the pin 38. This drives the translation of the pins 34, which slide while being guided in the grooves. The pivot point 32 being fixed, each segment 28 turns around it and goes between the two cams 22 and 24, under the dial 16. Advantageously, the side of the segments 28 connecting the thin end to the pivot point 32 presents a radius of curvature similar to that of the lower edge of the dial. In the open position, the center of the module, and in fact the entire surface of the module with the exception of the edge occupied by the dial, is completely released.

Inverse rotation of the cams 22 and 24 makes it possible to close the diaphragm.

The two levels of segments 28 are intended to slide on each other. They are therefore preferably made of a material having a low coefficient of friction, a ceramic, for example.

Control

In the example described, the covering device is combined with a clockwork comprising a minute repeater controlled by a slide not shown and a rack 42 connected to the slide by an arm 42*a*.

The cams 22 and 24 are made to rotate by a control lever 40 actuated, at least in part, from the outside of the watch case. In the embodiment described, the lever 40 is connected to the rack 42. More specifically, the lever 40 is installed on a bridge 44 and pivots on a point 46 offset relative to the pivot point 48 of the rack. Thanks to a pin 50 fixed on the bridge and sliding in an oblong piece 52 located in the lever 40, the travel of this lever is increased relative to that of the slide.

As will better be seen in FIGS. 3 to 7, the free end of the lever 40 ends in a finger 54. It bears, under it, a ratchet 56 pivotally mounted and intended to cooperate with the portion 38*a* of the pin to cause the cams 22 and 24 to rotate. This ratchet 56 is equipped with a catch 58 bearing on the side of the finger so as to block the ratchet when it pushes the pin 38 during opening of the diaphragm.

Moreover, the end of the pin 38 is fixed to a piston 60. This piston 60 is made up of a curved rod 62, having the same radius of curvature as the dial. It slides in two guides 64 integral with the bottom and goes into a helical spring 66. This helical spring is fixed to the rod 62 by its end located on the side of the pin 38 and bears, by its other end, on one of the guides 64. As will be better understood below, the spring ensures the return of the pin 38 to its locking position, and therefore closing of the diaphragm.

The control unit 12 also comprises a system for delaying the return of the shutter 10 to its first position. This shutter comprises a first lever 68 as release member for returning the shutter 10 to its first position. The lever 40 bears on a first end 68*a* of the lever 68 when it is in its locking position. The other end 68*b* bears a pin 70 cooperating with a hook 72*a* formed by the first end of a second lever 72. The other end of this lever is provided, from the outside of the case, with a boss 72*b* and, from the side of the clockwork, a housing 72*c* making it possible to ensure the function of the hooking member of the linking piece. A spring body 74 bears on the boss 72*b* and exerts pressure pushing the housing 72*c* toward the center of the clockwork. The spring 74 maintains the housing 72*c* on the trajectory of the pin 38 and thus makes it possible to maintain the hooking member in a position in which it cooperates with the linking piece. The force of the spring 74 is less than that of the spring of the striking barrel.

The interactions between the different elements will be better understood in reference to FIGS. 3 to 7, illustrating the evolution of the mechanism during an operation cycle.

FIG. 3

The mechanism is in its locking position and the diaphragm is closed. Under the effect of the striking mechanism barrel (not shown) whereto it is connected through the rack 42, the lever 40 pushes on the first lever 68 and, by the pin 70 which bears on the lever 72, slightly lifts the leaf spring 74.

FIG. 4

The minute repeater is in the winding process. The slide of the minute repeater is released by the wearer of the watch, which causes the rack 42 and therefore the lever 40 to pivot. The latter stops bearing on the lever 68. The spring 74 then pushes the housing 72*c*, in the direction of the center of the clockwork, to a position in which the hook 72*a* abuts on the pin 70.

The lever 40 bears on the portion 38*a* of the pin 38, pushes the piston 60 while constraining the spring 66 and causes the cams 22 and 24 to rotate, which results in opening the diaphragm, as explained above.

FIG. 5

The rack 42 and the spring 40 pursue their respective travels driving the pin 38. The spring 66 compresses and the diaphragm opens gradually.

When the pin 38 arrives near the housing 72*c*, it lifts the second lever 72. The mechanism is sized such that, when the lever 40 arrives at the end of its active travel, meaning that it is going to leave contact with the pin 38, the diaphragm is in its open position and the pin 38 has just exceeded, in its travel, the hooking member and more particularly the housing 72*c*. In this way, when the lever 40 leaves the pin 38, the spring 74 presses the lever 72 and the pin 38 places itself in the housing 72*c*. The helical spring 66 cannot decompress, and the diaphragm therefore remains in the open position. As an example, the diaphragm opens completely for a travel of the pin of approximately 25°.

One of the advantages of the system is that adjustment does not need to be perfect, since if the lever pushes the pin 38 a bit too far, the diaphragm is slightly too open, but the spring 66 brings the pin 38 back to bear in the housing 72*c*, adjusting the opening of the diaphragm. This recoil should, however, be minimal and it is necessary to anticipate it at the level of the pins 34 and the space occupied by the sectors 28 under the dial.

The lever 40 therefore ends its travel empty, following that of the rack 42 which varies according to the current time.

FIG. 6

The rack 42 returns to its locking position during striking of the minute repeater and brings the lever 40 back with it. The pin 38 is blocked by the housing 72*c*, which keeps the diaphragm open during striking, leaving the mechanism visible.

When the ratchet 56, during its return, crosses the pin 38, it pivots freely, which enables crossing without collision.

FIG. 7

Toward the end of the ring, the lever 40 returns to cooperate with the unit actuating the return of the shutter 10 to its first position by bearing on the first end 68*a* of the lever 68. The spring of the striking barrel being stronger than the spring 74, the lever 68 pivots and also drives the second lever 72, which pushes the spring 74 and frees the pin 38. Under the effect of the spring 66 with suddenly relaxes, the piston 60 and the pin 38 quickly return to their locking position, which closes the diaphragm, also rapidly.

Figure 8:
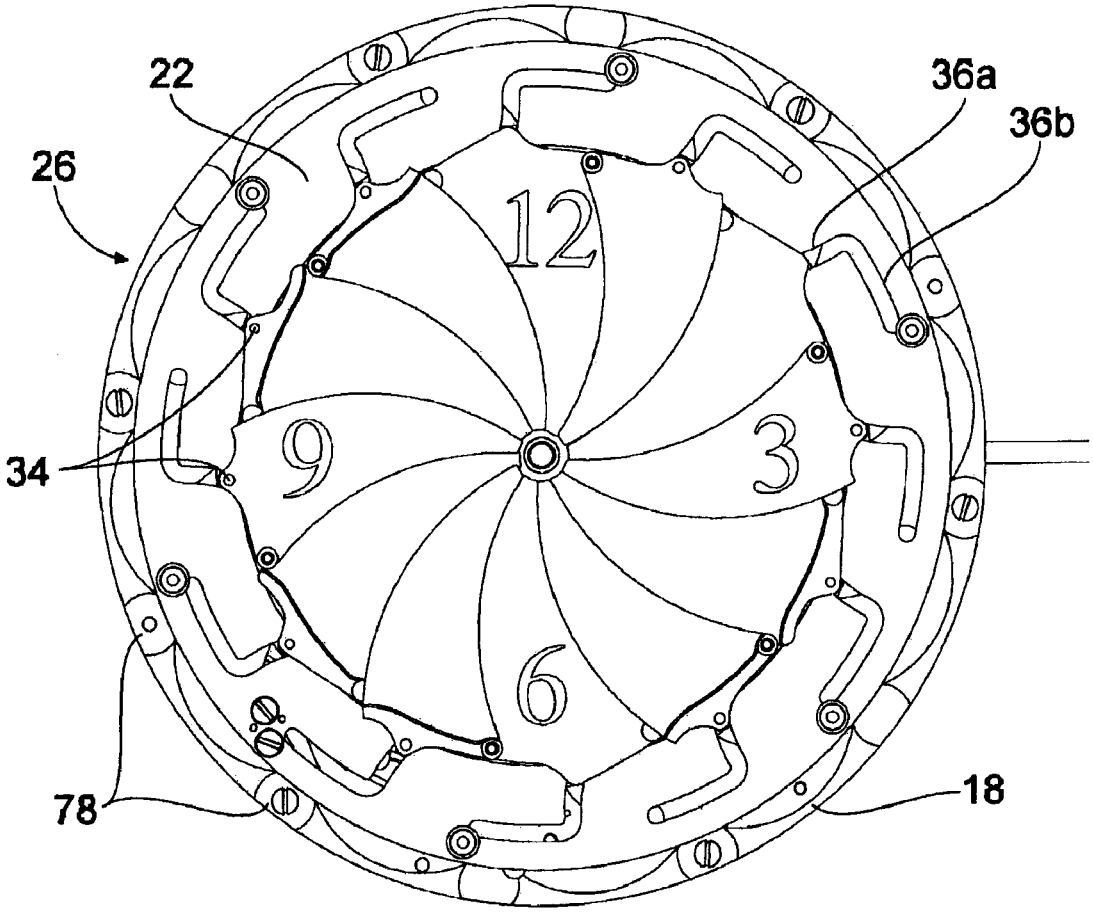
FIGS. 8 to 10 illustrate a second embodiment according to the invention.
Figure 9:
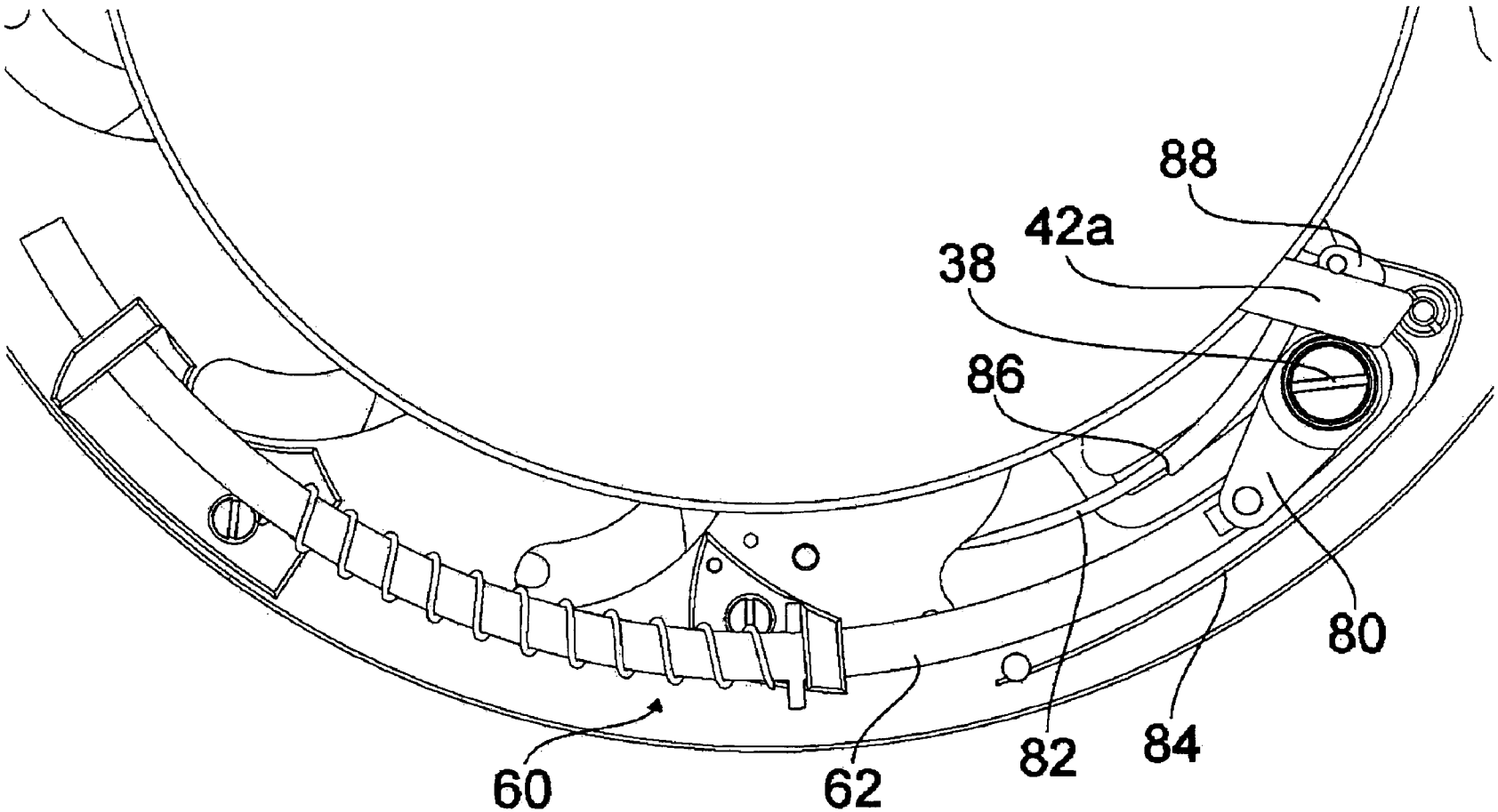
Figure 10:
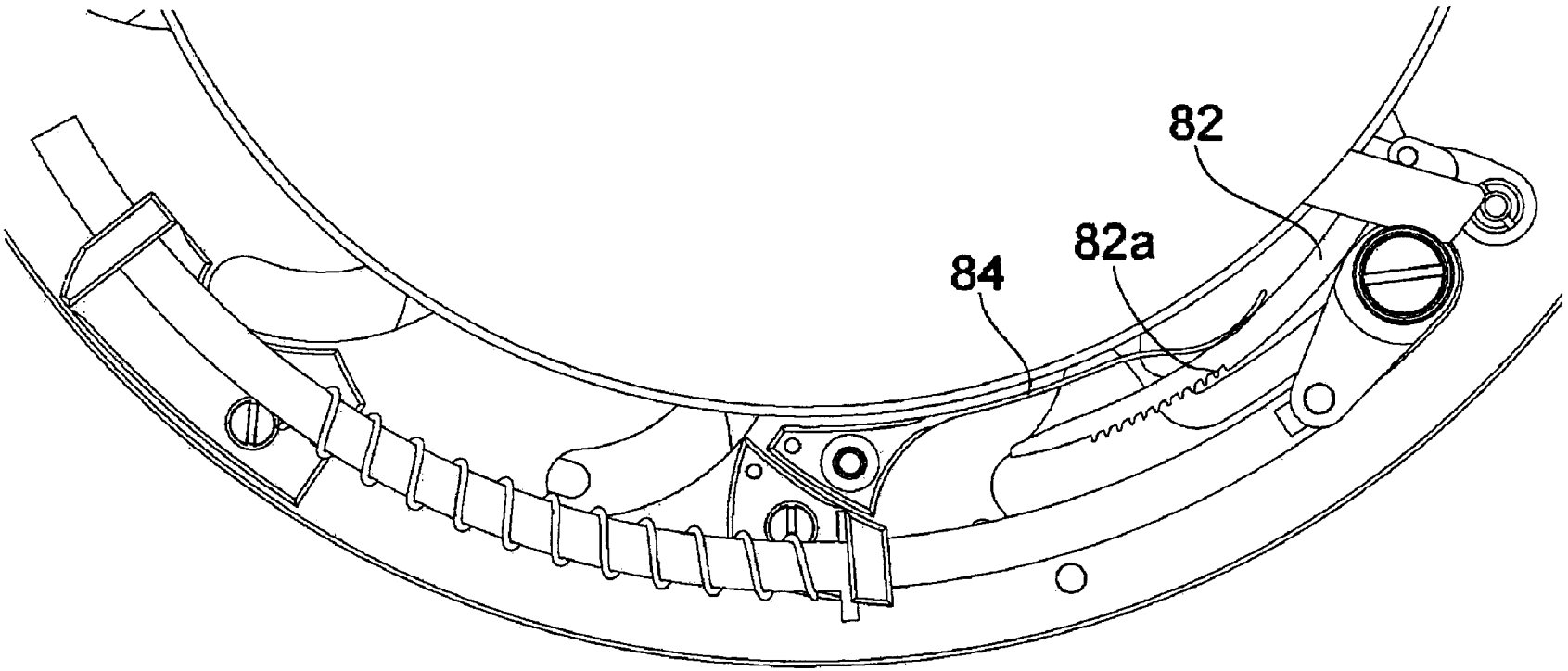

In a variation illustrated in FIGS. 8 to 10, the mechanism according to the invention comprises only one lower cam 22, still installed between jewels 26 and guided in rotation by contacts 78 disposed concentrically around the bottom 18 of the module. The pivot points of the sectors 28 still alternate between the dial 16, visible in FIG. 2, and the bottom 18. One of the primary differences of this embodiment relative to the one previously described is that all of the grooves 36 are positioned in the sole lower cam 22, the length of the translation pins 34 of all of the sectors 28 being sufficient to cooperate with them.

The grooves 36 each comprise a first active portion 36*a* and a second passive portion 36*b*. The active portion 36*a* is oriented following an essentially radial direction. More specifically, it is positioned such that, upon one rotation of the cam 22, the result of the forces exerted by the walls of this portion on the pin 34 with which they cooperate, drives the movement of this pin 34 from a first end to the other of the first portion, which causes the total opening of the diaphragm. In one preferred embodiment, the length of this first portion 36*a* is substantially equal to the travel of a pin 34 under the effect of the actuation of the rack 42 to strike one (1) hour.

The second portion 36*b* is oriented concentrically in relation to the clockwork, such that, when the pins 34 are engaged in this second portion, meaning once the travel made by the rack 42 has made it possible to load the spring of the striking barrel to strike at least one (1) hour, the rotation of the cam 22 no longer has any effect on the pins 34. Thus, the sectors 28 are immobile when the pins 34 move in this second portion.

Another particular aspect of this embodiment resides in the transmission of energy between the rack 42 and the pin 38, which is integral with the lower cam 22. More specifically, the pin 38 is integrated in the linking piece 80 integral with the rod 62 of the piston 60. To decrease friction, the piece 80 comprises in particular a roller on which the arm 42*a* of the rack 42 acts directly. The transmission of energy to open the sectors 28 of the diaphragm is thus favored due to the absence of the intermediary lever.

In reference to FIG. 9, the system for slowing the return of the shutter 10 to its first position comprises a lever 82. A spring unit 84 having a function similar to the spring 74 of the first embodiment maintains the lever 82 such that it bears on the linking piece 80. The hooking member is made up of a housing 86 similar to the housing 72*c* found on the lever 82. It is intended to cooperate with a catch not visible in the drawing, located on the linking piece 80. The release member for returning the shutter 10 to its first position takes the form of a post 88 serving to support the rack 42 when said rack is in its locking position, is disposed on the lever 82 such that the pressure applied by the rack 42 under the effect of the spring of the striking barrel causes rotational movement which opposes the spring 84. The force of said spring 84 is less than that of the spring of the striking barrel.

When in locking position, the rack 42 bears on the post 88. The pins 34 are positioned at the first end of the portion 36*a*, on the side opposite the second portion and the diaphragm is therefore closed.

Thus, in operating, when the wearer of the watch actuates the minute repeater slide, the rack 42 stops bearing on the post 88 and pushes the linking piece 80, which compresses the piston 60 and drives the rotation of the cam 22. At the control unit, the spring 84 bears on the linking piece 80, whereas at the shutter mechanism, the pins 34 move toward the second end of the first portion of the grooves, causing the diaphragm to open.

When the slide has been actuated over a travel equivalent to the actuation needed to strike one (1) hour, the pins 34 have reached the second end of the portion 36*a* and the diaphragm is completely open. Simultaneously, the catch of the piece 80 finds itself at the housing 86 and resides in it. Under the effect of the spring 84, the linking piece 80 can no longer move backwards, and the diaphragm is therefore maintained in its open position.

If the wearer continues to actuate the slide, the rack 42 pushes the pin 38 farther. The pins 34 move in the second portion 36*b* of the grooves, the movement of the rack 42 does not have any effect on the diaphragm. One will note that the bend formed by the portions 36*a* and 36*b* is sized such that the passage of the pins 34 from the first to the second portion is done without any locking.

The striking mechanism is then released in the traditional way and the rack 42 returns to its initial position as the spring of the striking barrel goes off. The pins 34 are still in the second portion 36*b* of the grooves and the diaphragm is open.

When the linking piece 80 arrives at the housing 86, the catch positions itself there and is kept there under the action of the spring 84. Only the rack 42 continues its travel while the striking mechanism finishes. At the shutter mechanism, given that maintaining the piece 80 causes the immobility of the cam 22, the pins 34 remain at the end of the second portion 36*b* located next to the first portion 36*a*, meaning that the diaphragm is kept completely open during the end of the striking.

When the striking ends, the rack 42 comes into contact with the post 88. Thanks to the spring of the striking barrel, the lever 82 pivots, which frees the post of the linking piece from the housing 86. Under the effect of the spring 66 which suddenly decompresses, the piston 60 and the pin 38 quickly return to their locking positions. The pins 34 are then driven by the cam 22 toward the first end of the first portion 36*a* of the grooves, which closes the diaphragm, also quickly.

In this variation, the shape of the grooves 36 is particularly suited to the mode of energy transmission between the rack 42 and the pin 38, as it advantageously makes it possible to take into account the fact that the rotation of the cam 22 and that of the rack 42 are not concentric.

This groove shape may be reproduced with a system comprising two cams, as described in the first embodiment.

It is possible that the release of the piston 60, in pressing on the rack 42 when striking begins, slightly accelerates the rhythm of this striking. This drawback may be avoided by using means for regulating the pressure of the piston 60. An example is illustrated in FIG. 10. The lever 82 comprises a toothed sector 82*a* intended to cooperate with the linking piece 80 or with the roller which it comprises. Another possible embodiment for the spring 84 is illustrated. Thus, as the striking progresses, at least one part of the force exerted by the piston 60 is no longer exerted on the rack 42, but rather on the roller. The speed of the striking is then essentially regulated by the spring of the striking barrel and by the normal regulation device for the striking mechanism, which may be an escapement or a centrifuge system.

What is proposed is thus a watch whereof the dial opens to leave the clockwork visible. In the case of a combination with a minute repeater mechanism, the dial remains open throughout the entire duration of the striking mechanism and closes suddenly at the end.

The above description has been provided in reference to a watch clockwork comprising a minute repeater mechanism, but the invention may be associated with other types of striking mechanisms whereof the release is controlled by the wearer.

What is claimed is:

1. A watch provided with a clockwork comprising a striking mechanism whose release is controlled from the watch outside by a means of a control unit, a dial comprising an opening, a shutter movable between a first position, in which it covers said opening, and a second position, in which it leaves said opening free, wherein said control unit is arranged in such a way that it enables the shutter to be moved from the first to the second position thereof when the striking mechanism is released.

2. The watch of claim 1, wherein said shutter comprises a plurality of segments distributing alternately in two levels and forming a diaphragm of the type used in photographic devices.

3. The watch according to claim 2, wherein the segments are installed rotatingly in a point and each comprising a pin, the pivoting of said segments being released by at least one cam, cinematically connected to said control unit and comprising guiding means cooperated with said pins.

4. The watch of claim 3, wherein said guiding means are grooves: comprising a first portion oriented following an essentially radial direction relative to the clockwork and a second portion oriented concentrically relative to the clockwork.

5. The watch of claim 1, wherein said control unit comprises a system for delaying the return of the shutter to its first position.

6. The watch of claim 5, in which said control unit is connected to said shutter by a linking piece connected to a piston, wherein said delay system comprises:

a hooking member able to occupy a first position in which it leaves said linking piece free and a second position in which it cooperates with the linking piece, a spring member intended to maintain said hooking member in its second position, and a release member released upon the return of the control unit to its locking position, to oppose the force exerted by said spring and allow the passage of the hooking member from its second to its first position.

7. The watch of claim 6, wherein:

said release member is a first lever bearing a pin, said hooking member is a housing located on a second lever provided with a hook cooperating with said pin, the spring member bears on said second lever to block said piston in the compressed position while maintaining said pin in said housing.

8. The watch of claim 6, wherein:

said hooking member is a housing made in a lever, said release member is a post disposed on said lever, the spring member maintains the lever such that it bears against said linking piece.

9. The watch of claim 2, wherein said control unit comprises a system for delaying the return of the shutter to its first position.

10. The watch of claim 9, in which said control unit is connected to said shutter by a linking piece connected to a piston, wherein said delay system comprises:

a hooking member able to occupy a first position in which it leaves said linking piece free and a second position in which it cooperates with the linking piece, a spring member intended to maintain said hooking member in its second position, and a release member released upon the return of the control unit to its locking position, to oppose the force exerted by said spring and allow the passage of the hooking member from its second to its first position.

11. The watch of claim 10, wherein:

said release member is a first lever bearing a pin, said hooking member is a housing located on a second lever provided with a hook cooperating with said pin, the spring member bears on said second lever to block said piston in the compressed position while maintaining said pin in said housing.

12. The watch of claim 10, wherein:

said hooking member is a housing made in a lever, said release member is a post disposed on said lever, the spring member maintains the lever such that it bears against said linking piece.

* * * * *